US005151072A

United States Patent [19]

Cone et al.

[11] Patent Number: 5,151,072

[45] Date of Patent: Sep. 29, 1992

[54] FREE WEIGHT BARBELL SPOTTING AND RACKING MACHINE

[76] Inventors: Dennis E. Cone, 1726 5th Ave., Oakland, Calif. 94606; James H. Gibson, 1511 150 Ave. #14, San Leandro, Calif. 94578

[21] Appl. No.: 699,916

[22] Filed: May 14, 1991

[51] Int. Cl.[5] ..... A63B 21/078

[52] U.S. Cl. ..... 482/104

[58] Field of Search ..... 272/123, 117, 134, 144; 482/93, 104, 106, 142

[56] References Cited

U.S. PATENT DOCUMENTS

| | | | |
|---|---|---|---|
| 4,249,726 | 2/1981 | Faust | 272/123 |
| 4,253,662 | 3/1981 | Podolak | 272/123 |
| 4,256,301 | 3/1981 | Goyette | 272/123 |
| 4,471,956 | 9/1984 | Marlo | 272/123 |
| 4,540,171 | 9/1985 | Clark et al. | 272/123 X |
| 4,615.524 | 10/1986 | Sutherland | 272/123 |
| 4,650,185 | 3/1987 | McCreery et al. | 272/123 X |
| 4,799,672 | 1/1989 | Barrett | 272/123 |
| 4,807,875 | 2/1989 | Tanski | 272/123 |
| 4,949,959 | 8/1990 | Stevens | 272/123 |

*Primary Examiner*—Robert Bahr

[57] ABSTRACT

A free weight lifting apparatus adapted for to return of a Free Weight Barbell (6) to a stationary barbell support rack (3), without other ancillary assistance, for a lone exerciser participating in a variety of free weight lifting exercises, including negative lift exercises. A reciprocating frame assembly (2) adapted for the upward and rearward travel of a Free Weight Barbell (6) in the direction of the stationary barbell support rack (3). The reciprocal frame assembly is comprised of a pair of horizontal arms (4) with an electrical switch (11) secured to each arm and a sleeve (5) pivoted over each switch (11). The reciprocal frame (2) reciprocates in or about a fixed vertical frame (1). The frame (2) is raised and lowered by an hydraulic cylinder (8) which is powered by an electrically driven pump (24). The electrical switches (11) are activated when the free weight barbell (6) depresses the sleeves (5) and are deactivated when the barbell automatically rolls off the sleeves and repositions itself on the support rack.

3 Claims, 5 Drawing Sheets

FREE WEIGHT BARBELL SPOTTING AND RACKING MACHINE

BACKGROUND

1. Field of the Invention

This invention relates to the practice of weight lifting as a form of physical exercise. The rules of POWER LIFT COMPETITION require that lifts be made with Free weights; that is, Barbells free of safety chains and/or cables, as well as being unrestricted by mechanical devices in the lateral plane.

Currently, the standard procedure, recommended by those persons governing the sport, is for the exerciser to be accompanied and observed by one or more assistants. In the event that the individual in unable to return the Barbell to its stationary rack, the assistants take over and replace the Barbell in its rack, thereby avoiding injury to the exercising individual. The foregoing procedure is known as "Spotting." Quite frequently, however, the individuals disregard the need for assistants and proceed to exercise alone, sometimes to the point of exhaustion at which time, being unable to return the Barbell to the stationary rack, they have suffered very serious, sometimes fatal injuries.

2. Description of Prior Art

There are other devices and inventions which remove a Barbell from the chest or shoulders of an exhausted exerciser; they are, however, variously limited in their operation:

a. U.S. Pat. No. 4,249,726 to Faust discloses a device which relieves the user of a Barbell, but does not automatically return a Free Weight Barbell to a stationary rack.

b. U.S. Pat. No. 4,253,662 to Podolak discloses a device which relieves the user of a captive Barbell, but does not automatically return a Free Weight Barbell to a stationary rack.

c. U.S. Pat. No. 4,540,171 to Clark et al, discloses a device which alternatively adds and removes an addition weight to the Barbell, but does not relieve the user of a Free Weight Barbell and automatically return the Barbell to a stationary rack.

d. U.S. Pat. No. 4,615,524 to Sutherland discloses an adjustable rack which does not relieve the user of the Barbell nor does it return the Barbell to a stationary rack.

e. U.S. Pat. No. 4,650,186 to McCreery et al, discloses a manually operated device, the nature of which is not automatic and could not relieve a disabled user of a Free Weight Barbell and return the Barbell to a stationary rack.

f. U.S. Pat. No. 4,799,672 to Barrett discloses a device which relieves the user of a Barbell, but does not automatically return the Barbell to a stationary rack.

g. U.S. Pat. No. 4,807,875 to Tanski discloses a device which relieves the user of a Barbell, but does not facilitate multiple repetitions of a given exercise when used in the automatic mode, being unsuitable thereby for use by a disabled person. Furthermore the device is unsuitable for competitive use since any contact of the Barbell with any part of the apparatus negates the exercise. A further disadvantage of the device is that if an electrical or mechanical failure should occur between the time of activation and time of actual recovery, the unfortunate user could possibly suffer severe, if not fatal, injury.

h. U.S. Pat. No. 4,949,959 to Stevens discloses an apparatus which relieves the user of a captive Barbell, but does not automatically return a Free Weight Barbell to stationary rack.

i. U.S. Pat. No. 4,799,674 to Ochab discloses a device which prevents a captive Barbell from injuring its user, but does not return a Free Weight Barbell to a stationary rack.

SUMMARY OF THE INVENTION

This invention allows the user to safely follow several different weight-lifting regimens: The Bench Press, The Incline Press, The Military Press, The Squat Lift, The Negative Lift. etc. The invention was primarily designed as a safety device to be used by a lone exerciser, but it may be used also by competitors in the sport of Weight-Lifting, since it does not contravene the rules of the sport. It may readily be seen that the present invention provides an heretofore unavailable safety device to both novice and expert alike. A further object of the present invention is to provide a reliable apparatus by combining well proven engineering concepts with simple sturdy construction to affect a swift and immediate recovery from a potentially fatal situation.

DRAWING FIGURES

REFERENCE NUMERALS IN THE DRAWINGS

1. Fixed Frame
2. Reciprocating Frame
3. Stationary Rack
4. Horizontal Arms
5. Pivoted Sleeve(s)
6. Barbell
7. Base
8. Hydraulic Cylinder/Ram
9. Lower Ram Anchor
10. Upper Ram Anchor
11. Electrical Switch(es)
12. Peg Hole(s)
13. Peg Stop(s)
14. Sleeve Pivot Point
15. Stop Peg(s)

16. Sleeve Biasing Springs
17. Electrical Wire
18. Guide Roller(s)
19. Sleeve Pivot Pin
20. Aperture for Hydraulic Ram
21. Sleeve Stop and Spring Housing
22. Bench
23. Electrical Motor
24. Hydraulic Pump
25. Hydraulic Fluid Reservoir
26. Hydraulic Valve
27. User

DESCRIPTION

Figure 1:
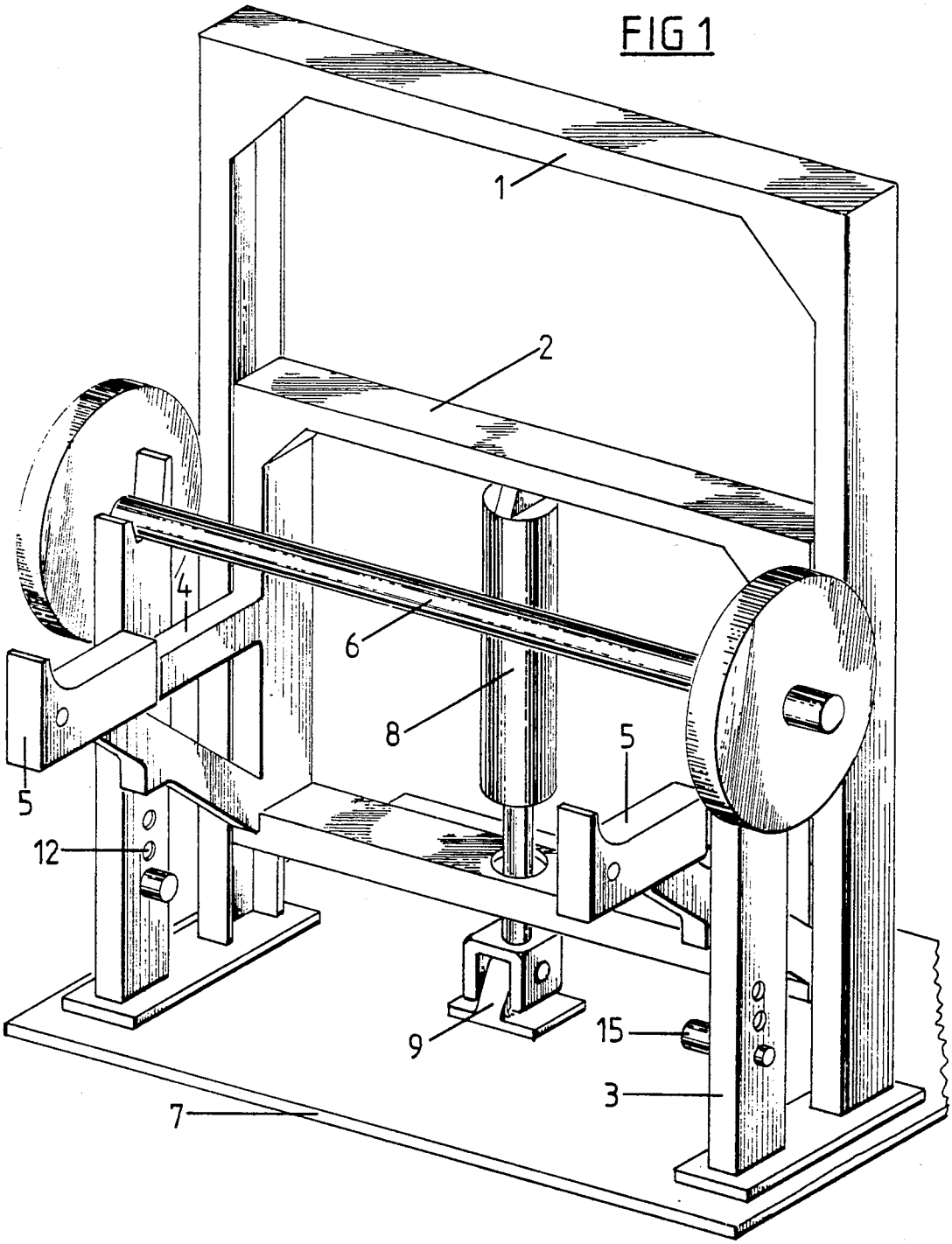
FIG. 1 is a simplified perspective view showing the general arrangement of the apparatus. The hydraulic pump, lines and valves have been omitted for clarity as have the outer cosmetic covers.
Figure 2:
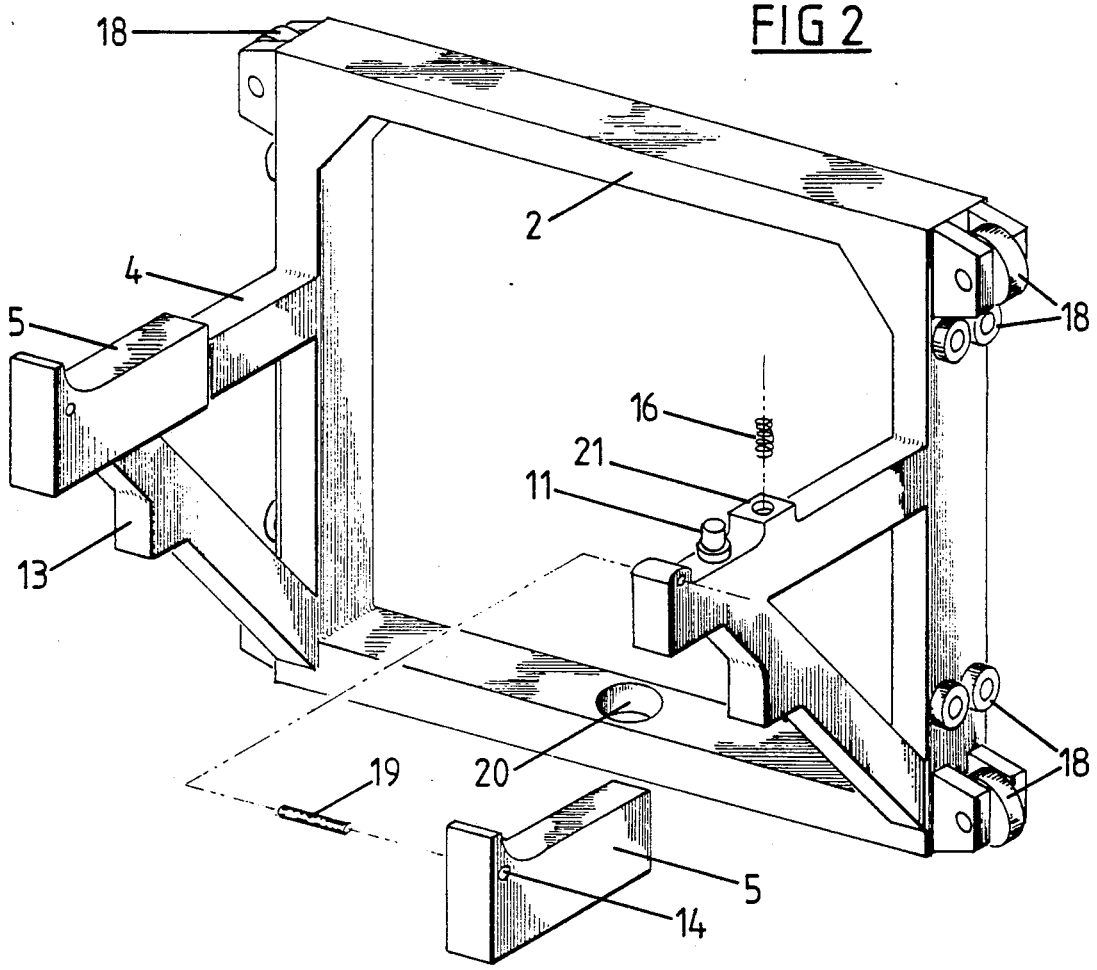
FIG. 2 is a perspective view of the reciprocating frame assembly, showing an exploded view of the left horizontal arm and pivoting sleeve.
Figure 3:
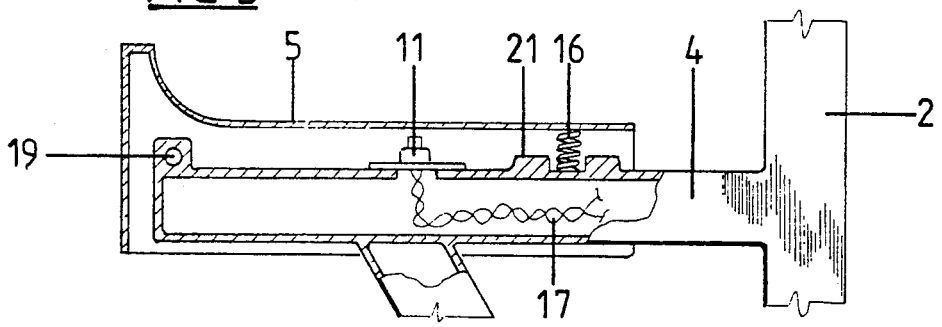
FIG. 3 is a fragmented, section view of the horizontal arm and pivoting sleeve assembly.
Figures 4, 5:
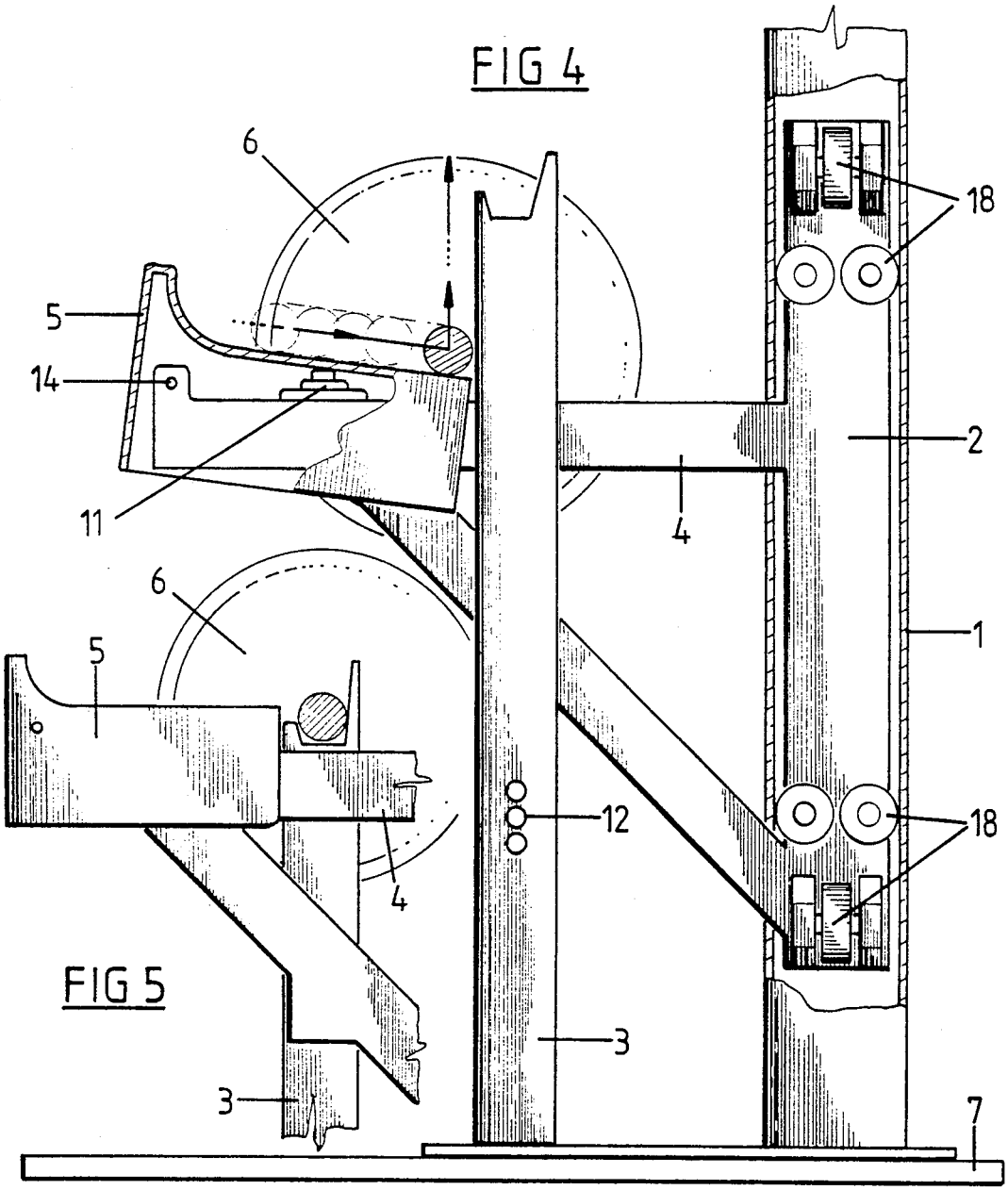
FIG. 4 is a partly sectioned side elevation depicting the apparatus in operation.
FIG. 5 is a fragmented side elevation showing the invention at the completed recovery stage.
Figure 8:
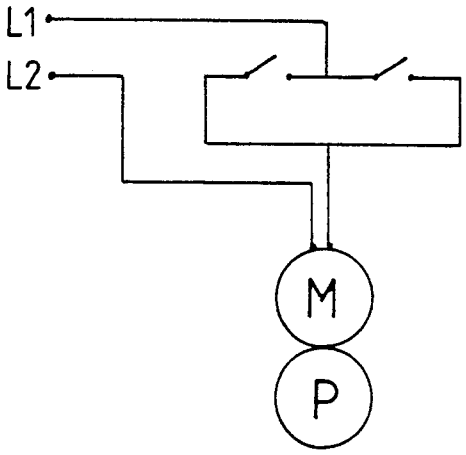
FIG. 8 is a simplified diagramatic representation of the primary electrical circuit.
Figure 7:
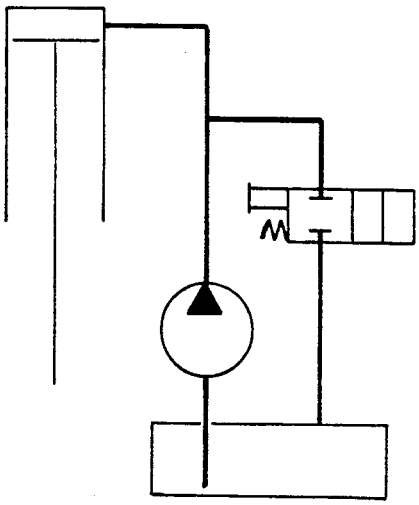
FIG. 7 is a simplified diagramatic representation of the hydraulic circuit.
Figure 6:
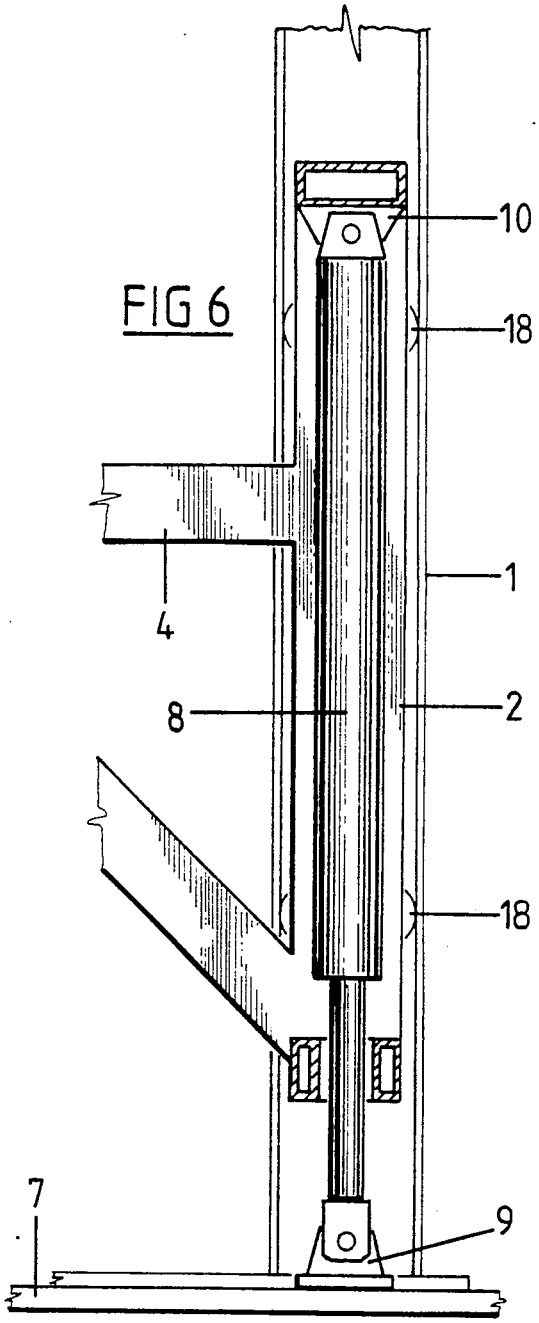
FIG. 6 is a fragmented, sectional side elevation showing the hydraulic cylinder/ram arrangement.
Figures 9, 10:
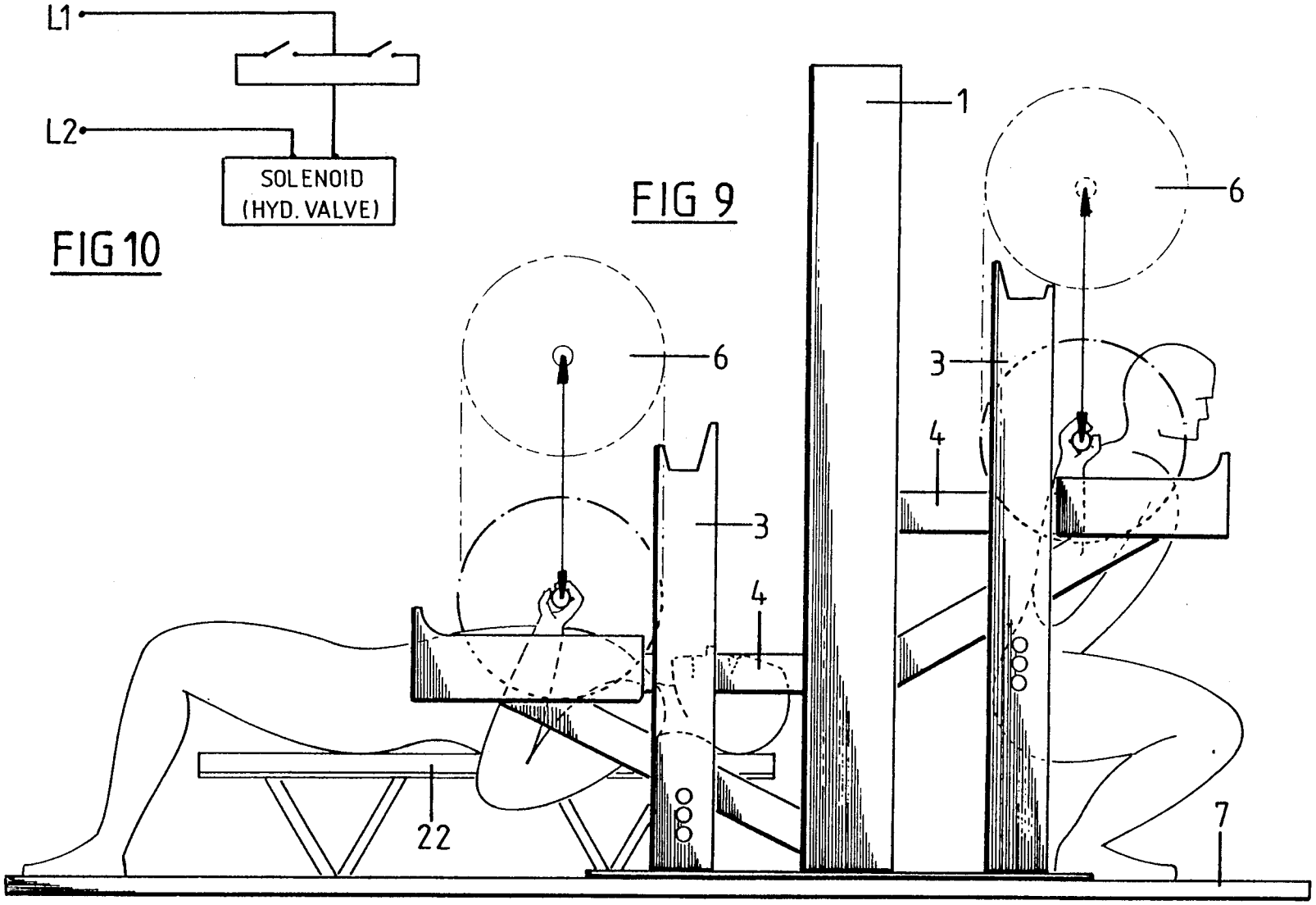
FIG. 9 is a side elevation of the invention showing a dual purpose variant of the invention, depicting on the left side a user preparing to "Bench Press" a Free-Weight Barbell, and on the right side a user is participating in the "Squat Lift" exercise.
FIG. 10 is a simplified, diagramatic representation of the secondary electrical circuit.

In FIG. 1, it can be seen that a fixed stationary frame (1) of suitable proportions facilitates a reciprocal movement of a sub-frame assembly (2). This is also illustrated in FIG. (4). The reciprocal movement is caused and controlled by the hydraulic ram assembly (8). The ram, being attached by its upper end to the frame (2) by upper ram anchor (10) and to the base (7) by the lower ram anchor (9). The frame (2) carries two horizontal arms (4) firmly affixed as seen in FIG. (2). Each of these arms carries a sleeve (5) pivoting about an axis (14) on a pivot pin (19); additionally each sleeve (5) is biased upwards by the sleeve biasing springs (16). Concealed beneath each sleeve (5) is an electrical switch (11). Both of these switches are operatively connected to an electric motor (23) and hydraulic pump (24). FIGS. 1, 4 and 9 ably illustrate the placement of two vertical members (3) (3) combining to form a stationary rack (3) (3) upon which a barbell (6) rests. An adjustable bench (22) is provided for the user (27) to recline upon. Provision is made in the stationary rack (3) (3) for the insertion of stop pegs (15) (15) by providing a plurality of peg holes (12) (12). A triangular shaped projection (13) is arranged on the under side of each horizontal arm assembly (14), and are conveniently placed so as to provide a positive lower location for the reciprocating frame assembly.

OPERATION OF THE INVENTION

FIG. 9. Illustrates two basic forms of weight-lifting exercise, at left the supine position and at right the erect posture. The apparatus can be arranged to facilitate either or both of these forms. The mode of operation is identical in both cases.

This present invention provides the required stationary rack from which the barbell must be removed at the beginning of the exercise and upon which the barbell must be replaced at the end of each exercise. A removable, adjustable bench is also provided for those regimens requiring its use. A pair of horizontal arms, each bearing a pivoted sleeve, lay at rest adjacent to the stationary rack; the exact rest position is arbitrary and is pre-adjusted to suit the physique of the individual exerciser as follows: The horizontal arms are lowered to a point where they are parallel with the resting position of the exerciser. The exerciser's chest will expand while exercising, thereby allowing the exerciser to facilitate the exercise without touching the horizontal arms until the user is exhausted. Furthermore, power failure is of no consequence with the exhausted exerciser, because the horizontal arms (4) will support the barbell (6) and allow the user to get off the bench (22) unharmed.

When barbell (6) of a commonly known type is allowed to depress the pivoting sleeves (5), the normally open electrical switches (11) are closed, the electric motor (23) powers the hydraulic pump (24) causing fluid to flow from the reservoir (25) to the hydraulic cylinder and ram assembly (8) thereby raising the sliding frame (2) within the fixed frame (1). The sliding frame (2) is equipped with a plurality of guide rollers (18) to facilitate this movement. Since the sliding frame (2) is integral with the horizontal arms (4), the barbell (6) is carried upward and rearward until it is free to roll onto and into the stationary rack (3). This is illustrated in FIG. 4 and FIG. 5. At this juncture the springs (16) return the pivoted sleeves (5) to the horizontal position, thus allowing the switches (11) to re-open, stopping the motor (23) and the pump (24). At this time the barbell (6) is held captive within the upper extremities of the stationary rack (3) by its own weight. In order to progress with more exercises, the horizontal arms (4) must be lowered to a predetermined position dictated by the user's physique and facilitated by the stop pegs (15) being inserted into the peg holes (12). The horizontal arms (4) are lowered until the peg stops (13) engage the stop pegs (15) by manually operating a normally closed hydraulic valve (26) allowing the entrapped fluid to flow from the cylinder (8) to the reservoir (25).

The apparatus is not ready for further use.

While the description of this invention contains many specifications, these should not be construed as limitations on the scope of the invention, but rather as an exemplification of the preferred embodiments thereof. Many other variations are possible. The horizontal arms (4) could be made to continuously reciprocate up and down at a speed suitably adjusted, so that the user may exercise in synchronization with the motion of the arms. In this embodiment, the Barbell (6) would be returned to the Stationary Rack (3) when released by the user.

Additional electrical switches could be activated when the Barbell (6) comes to rest on the Stationary Rack (3), causing the horizontal arms to automatically return to and remain at its pre-set lower position.

Movement of the horizontal arms could be initiated by the interruption of a light beam, commonly known as an "electric eye."

This apparatus could also be arranged to facilitate activation by a third person; for example, a referee or judge during a competitive event.

We claim:

1. A barbell exercise apparatus comprising:

a stationary frame;

a stationary rack for retaining a barbell thereon associated with said stationary frame;

a reciprocating frame having a pair of parallel horizontally extending arms, the arms having a distal end remote from the stationary frame, the reciprocating frame mounted within or about the stationary frame for vertical reciprocal movement thereon;

a pair of switches, one switch mounted on each arm between the ends thereof;

a pair of sleeves, one sleeve pivotally mounted to the distal end of each of the pair of arms, each sleeve overlaying the respective distal portion of the arm and switch such that downward pivotal movement of the sleeve activates its respective switch;

biasing means for normally biasing the sleeves upwardly away from the arms; and, an electrically powered hydraulic cylinder mounted on the stationary frame, the reciprocating frame mounted to the electrically powered hydraulic cylinder such that actuation of the electrically powered hydraulic cylinder causes upward vertical movement of the reciprocating frame, the switches operatively connected to the electrically powered hydraulic cylinder such that activation of the switch causes actuation of the electrically powered hydraulic cylinder and concurrent upward vertical movement of the reciprocating frame;

whereby engagement of the barbell on the sleeves and horizontally extending arms causes downward pivoting of the sleeve thus activating the switch, which in turn actuates the electrically powered hydraulic cylinder, which in turn causes upward vertical movement of the reciprocating frame having horizontally extending arms, thus removing the barbell from the weight lifter.

2. The barbell exercise apparatus of claim 1 further comprising a hydraulic valve operatively connected to the electrically powered hydraulic cylinder such that actuation of the valve returns the reciprocating frame to its lower position.

3. The barbell exercise apparatus of claim 2 further comprising a secondary electrical circuit operatively connected to the hydraulic valve, the secondary electrical circuit activated at a predetermined vertical position of the reciprocating frame such that the reciprocating frame is automatically returned to its lower position.

* * * * *